US009211440B2

(12) United States Patent
Lagree

(10) Patent No.: US 9,211,440 B2
(45) Date of Patent: Dec. 15, 2015

(54) ADJUSTABLE EXERCISE SYSTEM

(71) Applicant: SPX Fitness, Inc., Burbank, CA (US)

(72) Inventor: Sebastien Anthony Louis Lagree, West Hollywood, CA (US)

(73) Assignee: SPX Fitness, Inc., Burbank, CA (US)

( * ) Notice: Subject to any disclaimer, the term of this patent is extended or adjusted under 35 U.S.C. 154(b) by 0 days.

(21) Appl. No.: 14/468,958

(22) Filed: Aug. 26, 2014

(65) Prior Publication Data

US 2015/0057127 A1 Feb. 26, 2015

Related U.S. Application Data

(60) Provisional application No. 61/869,904, filed on Aug. 26, 2013.

(51) Int. Cl.
*A63B 24/00* (2006.01)
*A63B 21/00* (2006.01)

(52) U.S. Cl.
CPC ..... *A63B 24/0087* (2013.01); *A63B 21/00* (2013.01); *A63B 24/0084* (2013.01)

(58) Field of Classification Search
CPC ..... A63B 24/00; A63B 24/0084; A63B 24/0087; A63B 21/00
IPC ..... A63B 24/00
See application file for complete search history.

(56) References Cited

U.S. PATENT DOCUMENTS

| | | | | |
|---|---|---|---|---|
| 4,240,627 | A | 12/1980 | Brentham | |
| 5,820,478 | A | 10/1998 | Wood | |
| 8,012,073 | B2 * | 9/2011 | Barnett | 482/142 |
| 2002/0022551 | A1 * | 2/2002 | Watterson et al. | 482/8 |
| 2006/0293156 | A1 * | 12/2006 | Trees | 482/148 |
| 2008/0242511 | A1 * | 10/2008 | Munoz et al. | 482/5 |
| 2009/0023556 | A1 * | 1/2009 | Daly et al. | 482/9 |
| 2011/0082016 | A1 * | 4/2011 | Kim | 482/94 |
| 2011/0152032 | A1 * | 6/2011 | Barnett | 482/5 |

(Continued)

FOREIGN PATENT DOCUMENTS

EP 0354785 2/1990

OTHER PUBLICATIONS http://www.walmart.com/ip/Total-Gym-1400/23816097?adid=15000000000000027727770; Webpage from Walmart.com for the Total Gym 1400; Received and Printed Aug. 25, 2014.

(Continued)

*Primary Examiner* — Glenn Richman
(74) *Attorney, Agent, or Firm* — Neustel Law Offices

(57) ABSTRACT

An adjustable exercise system for adjusting an exercise machine such as a Pilates machine between various angles of incline with respect to a fixed base to allow for a wider range of exercises. The adjustable exercise system generally includes a base, an exercise machine pivotably connected to the base, and one or more actuators, for lifting or lowering the exercise machine into varying angles of incline with respect to the base. The rear end of the base is generally pivotably connected to the rear end of the exercise machine by a hinge or pivot connectors. A controller is also provided which communicates via a wired or wireless communications network with one or more of the adjustable exercise systems. Using the controller, an exercise instructor may adjust the adjustable exercise systems of multiple exercisers with a single command.

22 Claims, 16 Drawing Sheets

(56) References Cited

U.S. PATENT DOCUMENTS

| | | | | |
|---|---|---|---|---|
| 2012/0071301 | A1 | 3/2012 | Kaylor | |
| 2012/0088634 | A1 * | 4/2012 | Heidecke | 482/2 |
| 2013/0150219 | A1 | 6/2013 | Chang | |

OTHER PUBLICATIONS

PCT International Search Report and Written Opinion; Received and Downloaded on Sep. 1, 2015.

* cited by examiner

ADJUSTABLE EXERCISE SYSTEM

CROSS REFERENCE TO RELATED APPLICATIONS

I hereby claim benefit under Title 35, United States Code, Section 119(e) of U.S. provisional patent application Ser. No. 61/869,904 filed Aug. 26, 2013. The 61/869,904 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to an exercise system and more specifically it relates to an adjustable exercise system for adjusting an exercise machine such as a Pilates machine between various angles of incline with respect to a fixed base to allow for a wider range of exercises.

2. Description of the Related Art

Any discussion of the related art throughout the specification should in no way be considered as an admission that such related art is widely known or forms part of common general knowledge in the field.

In 1912 England, Joseph Pilates worked as a self-defense instructor for detectives at Scotland Yard. At the outbreak of World War I, Pilates was interned in a detention camp as an "alien enemy". While interned, Pilates refined his ideas and trained other internees in his system of exercise. He rigged springs to hospital beds, enabling bedridden patients to exercise against spring resistance, an innovation that led to his ultimate development of what is known today as a Pilates apparatus.

Reflecting their hospital bed origin, Pilates apparatuses are generally comprised of a rectangular, horizontal base structure with parallel rails aligned with the major axis of the rectangular structure, and a sliding carriage thereupon that is attached to one end of the structure by springs or elastic bands that produce a resistance bias. Sliding the carriage away from the end of the apparatus to which the resistance means is attached creates a workload against which therapeutic exercises can be safely and beneficially performed.

Today, the Pilates method is divided into two philosophical camps. One group follows the classic Pilates method using the apparatus originally specified by Joseph Pilates. The second group follows a more modernized version of the Pilates method. The second group uses more contemporary Pilates apparatuses that incorporate various accessories to increase the scope and breadth of exercises that can be performed on the apparatus. These accessories typically include such devices as small-weighted balls, foam rollers, handlebars, large exercise balls, rotating disks, and resistance bands.

In today's on-the-go society, more adults are pursuing an active lifestyle, the results of which are an inherent increase in activity related injuries, and/or surgical procedures to repair degenerating joints or injuries in order to return to that active lifestyle. In cases where the modern Pilates apparatus is used as a central component of physical rehabilitation, many of the accessories available for the modern reformer apparatus are intended to support physiotherapy to accelerate post-operative healing, or to aid in the normal recovery process.

On the other hand, in the gym and body-building world, manufacturers have endeavored to create devices that significantly increase resistance for the sole purpose of building muscle and increasing strength, for instance, the inclined sit-up bench that forces the exerciser to start the sit-up with their legs elevated higher than their shoulders. From this position, the exerciser must work harder to accomplish a sit-up since they must first raise their shoulders to the level of their hips, then continue the exercise until their elbows touch their elevated knees.

For those trying to create shapely abdominal muscles, this exercise increases the resistance so that the exerciser accomplishes more work with each sit-up repetition compared to performing sit-ups on a horizontal surface. However, this position puts additional pressure on the spine and lower back of the exerciser, can cause injury, and most importantly, can further damage an already injured back of a person trying to recover from a previous injury.

By comparison, a Pilates reformer used for therapeutic rehabilitation does not have inclines thereby ameliorating the injury-inducing position of the popularized inclined sit-up bench. Between the intensity-increasing apparatuses found worldwide in muscle-building gyms, such as the inclined sit-up bench, and the smooth resistance-inducing apparatuses such as horizontal Pilates reformers, there is a demand and need for a novel and improved apparatus that provides for devices and methods that allow precise control of inclination, exercise resistance, and biomechanical positioning on the device to reduce the incidence of injury, and to conduct fitness training or therapeutic exercises on targeted muscles to aid in faster muscle development, or safer, accelerated injury recoveries.

It is well known to those skilled in the art that exercising against resistance stimulates muscle development. Weight-bearing exercises or resistance training reduces blood glucose, increases brain activity, reduces visceral fat and strengthens muscle fibers. On the other hand, improperly training with weights can damage joints, muscles and connective tissue. Resistance is introduced into exercise a number of ways. One example is the exerciser's own body weight (BW). When performing a pull-up or chin-up using a horizontal bar, the exerciser pulls their BW upward until their chin touches the bar. This is a difficult exercise, and many people cannot perform even one repetition, since their BW exceeds the muscle-pulling capability of their arms.

Another method of introducing resistance is the introduction of weights, such as dumbbells, barbells, or weight machines. The exerciser can select weights light enough to accomplish multiple repetitions. However, the risk of injuring muscles is very high without the requisite training on precise body positioning prior to lifting the weights. Form and proper weight all must converge to safely perform an exercise with heavy weights. Another problem with the use of weights when performing exercises on one major muscle group is the inability to eliminate stresses on muscles, joints or connective tissue that may be injured, and therefore require less beneficial training against significantly reduced weight.

Yet another method of introducing resistance to an exercise regimen on a horizontal Pilates apparatus is to attach springs or resistance bands between one stationary end of the apparatus and a slidable carriage. As the carriage is slid away from the stationary end, the springs or resistance bands stretch, thereby inducing a resistance that an exerciser must overcome by force in order to continue sliding the carriage away from the stationary end. The amount of resistance can be increased or decreased by adding or removing a number of springs or resistance bands connected between the carriage and stationary end. On a horizontal Pilates apparatus, the carriage supports substantially all of the exerciser's BW allowing the precise resistance to be introduced only to the muscles or muscle groups targeted by an exerciser or physiotherapist, thereby minimizing exposure of injured muscles, joints or connective tissue to excessive resistance.

Further, during any given exercise routine, and exerciser typically changes from a first exercise to a second exercise after completing the appropriate repetitions of the first exercise. This can be generally accomplished by two methods: changing positions to a completely different exercise, or increasing the resistance of a given exercise between sets of repetitions. A classic example of the later is an exerciser performing 10 repetitions of bicep curls using 10 pound dumbbells. After a minute rest, they repeat the 10 repetitions with 20 pound dumbbells, and after another minute of rest, completing a third set of 10 repetitions using 30 pound dumbbells.

A foundational tenet of the Pilates method is to always keep the body centered and balanced, minimize strain on muscles, connective tissue or joints, and induce a resistance force into an exercise. In this regard, it is well known that strain on the spine can be realized even when performing exercises on a horizontal Pilates apparatus, even though the exerciser's BW is fully supported by the apparatus.

Those skilled in the art will immediately appreciate the need for a novel an improved Pilates apparatus that can be inclined to substantially reduce strain on the spine and other joints, while at the same time combines particular features that allow for resistance to be simultaneously drawn from multiple sources such as springs, resistance bands or weights, plus all or a portion of the exerciser's own BW. Such a device would allow a trainer or physiotherapist to adjust the angle of inclination of a Pilates apparatus relative to the horizontal to decrease biomechanical forces acting on injured or injury-prone joints and tissue during exercise.

It will also be appreciated that an inclined Pilates apparatus would provide for increasing or decreasing a contributed portion of BW as a resistance source during an exercise by adjusting the angle of the apparatus in such a manner that when the longitudinal axis of the apparatus is in a horizontal position, the exerciser is exercising only against the resistance bands, and as one end of the longitudinal axis of the apparatus is elevated towards a vertical position, the exerciser is realizing a resistance of the resistance bands plus a controlled portion of their BW.

Changing the level of resistance during an exercise routine on a Pilates apparatus, for the purpose of engaging different muscles, increasing or decreasing exercise intensity and reducing strain and injury of joints and connective tissue, by means of engaging multiple resistance sources, is not known to have previously been accomplished, although the need to safely modify body position and exercise intensity during a session is well known by those skilled in physical conditioning and rehabilitation methods.

Because of the inherent problems with the related art, there is a need for a new and improved adjustable exercise system for adjusting an exercise machine such as a Pilates machine between various angles of incline with respect to a fixed base to allow for a wider range of exercises.

BRIEF SUMMARY OF THE INVENTION

The invention generally relates to an adjustable exercise system which includes a base, an exercise machine pivotably connected to the base, and one or more actuators, for lifting or lowering the exercise machine into varying angles of incline with respect to the base. The rear end of the base is generally pivotably connected to the rear end of the exercise machine by a hinge or pivot connectors. The front end of the exercise machine may be raised or lowered with respect to the front end of the base by the one or more actuators to achieve varying angles of incline. A controller is also provided which communicates via a wired or wireless communications network with one or more of the adjustable exercise systems. Using the controller, an exercise instructor may adjust the adjustable exercise systems of multiple exercisers with a single command.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
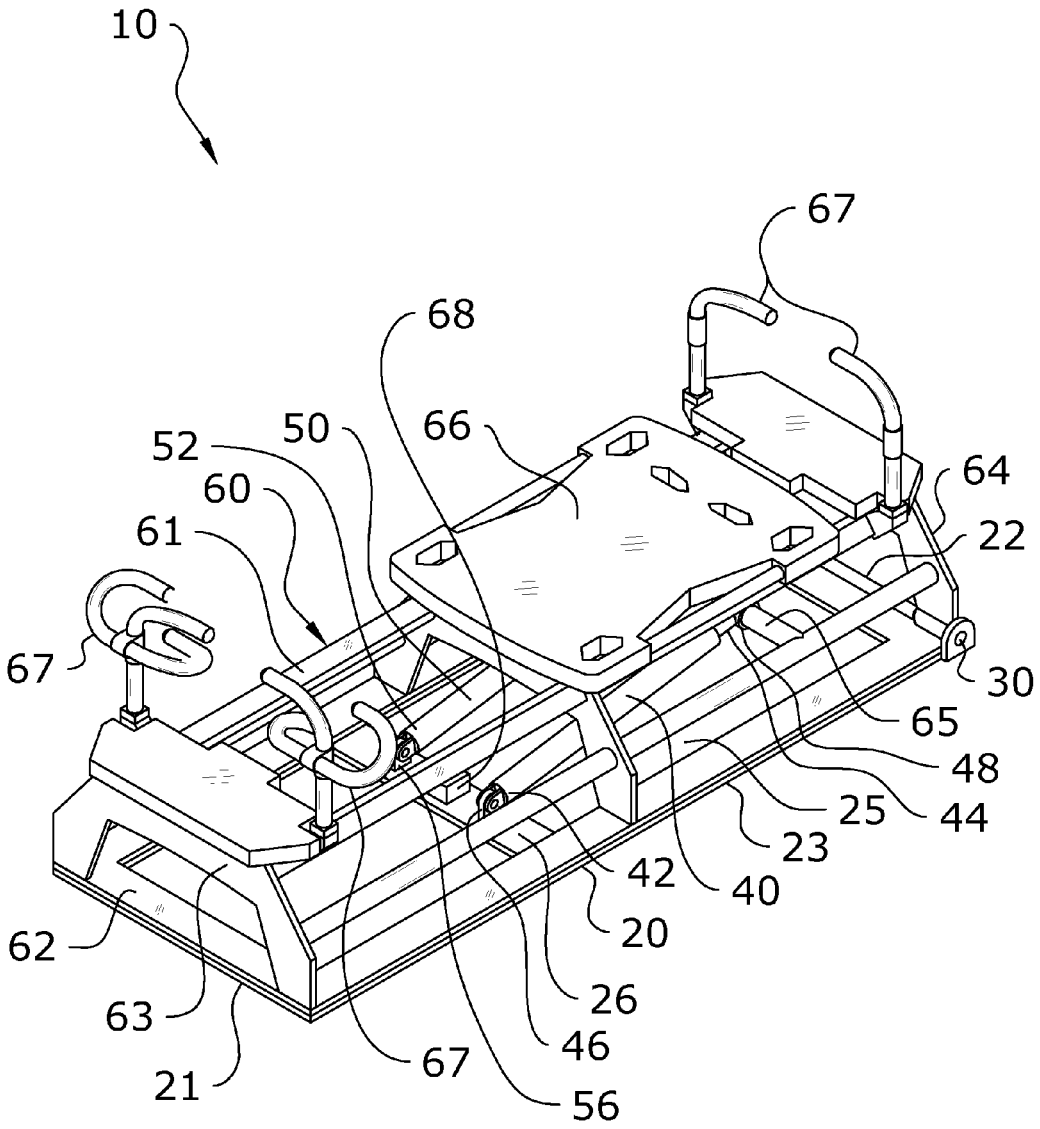
FIG. 1 is an upper perspective view of the present invention.

A. Overview.

Turning now descriptively to the drawings, in which similar reference characters denote similar elements throughout the several views, FIGS. 1 through 17 illustrate an adjustable exercise system 10, which comprises a base 20, an exercise machine 60 pivotably connected to the base 20, and one or more actuators 40, 50 for lifting or lowering the exercise machine 60 into varying angles of incline with respect to the base 20. The rear end 22 of the base 20 is generally pivotably connected to the rear end 64 of the exercise machine 60 by a hinge or pivot connectors 30, 32. The front end 63 of the exercise machine 60 may be raised or lowered with respect to the front end 21 of the base 20 by the one or more actuators 40, 50 to achieve varying angles of incline. A controller 70 is also provided which communicates via a wired or wireless communications network 12 with one or more of the adjustable exercise systems 10. Using the controller 70, an exercise instructor may adjust the adjustable exercise systems 10 of multiple exercisers with a single command.

B. Base.

As shown throughout the figures, the present invention includes a base 20 to which the exercise machine 60 of the present invention is hingedly attached such that a level of inclination of the exercise machine 60 may be adjusted to increase or decrease the intensity of exercises. The shape, structure, and configuration of the base 20 may vary in different embodiments, and thus the scope of the present invention should not be construed as limited by the exemplary configuration shown in the figures.

It should be appreciated that, in some embodiments, the base 20 may be comprised of any structure which interconnects the exercise machine 60 with a surface, such as legs contacting the floor. Thus, in some embodiments, an explicit base 20 may be omitted, with the ground surface being comprised of the base 20 for the exercise machine 60. In such embodiments, the actuators 40, 50 may be connected directly between the ground and the exercise machine 60.

Figure 2:
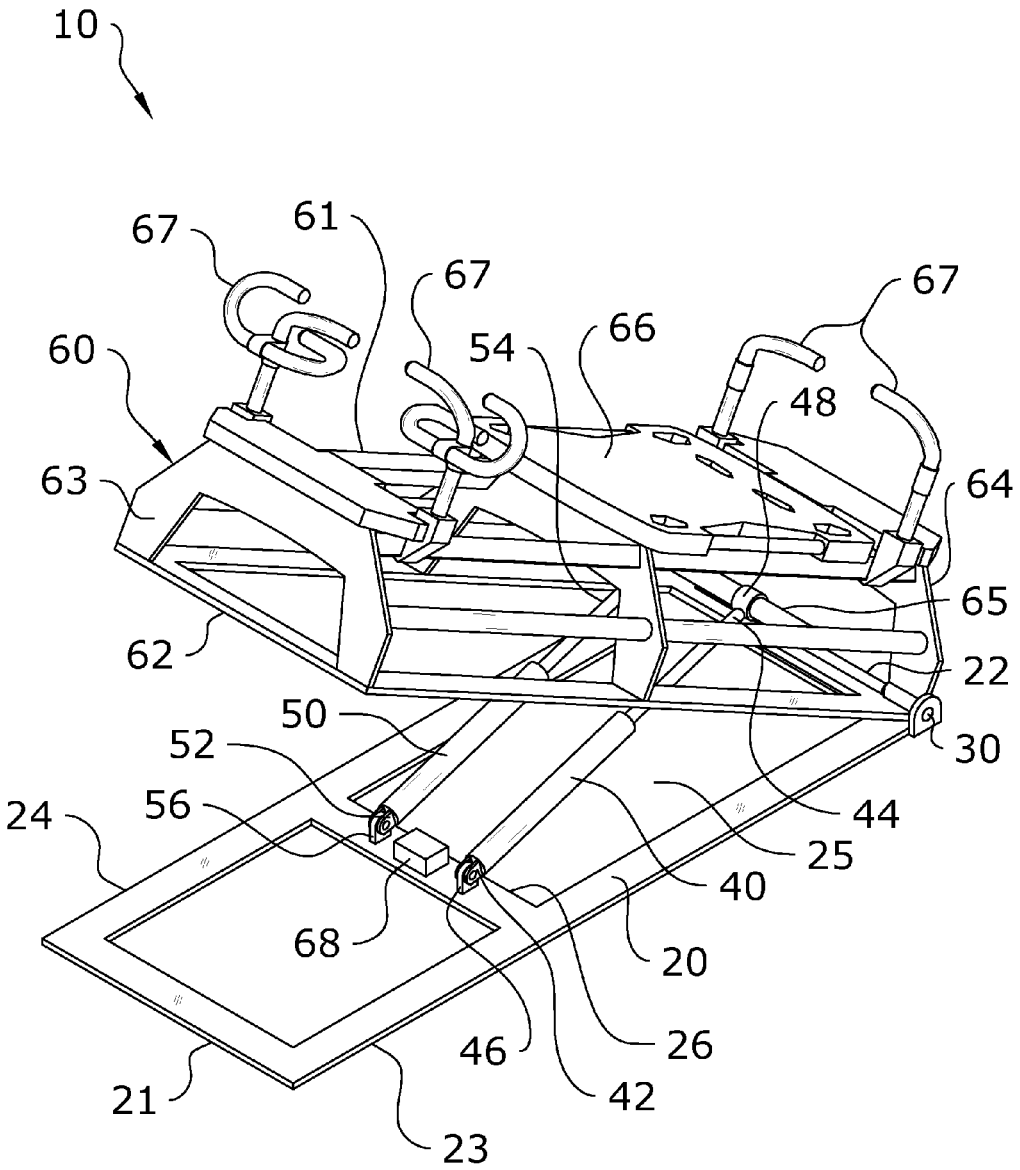
FIG. 2 is an upper perspective view of the present invention with the exercise machine in a raised position.
Figure 3:
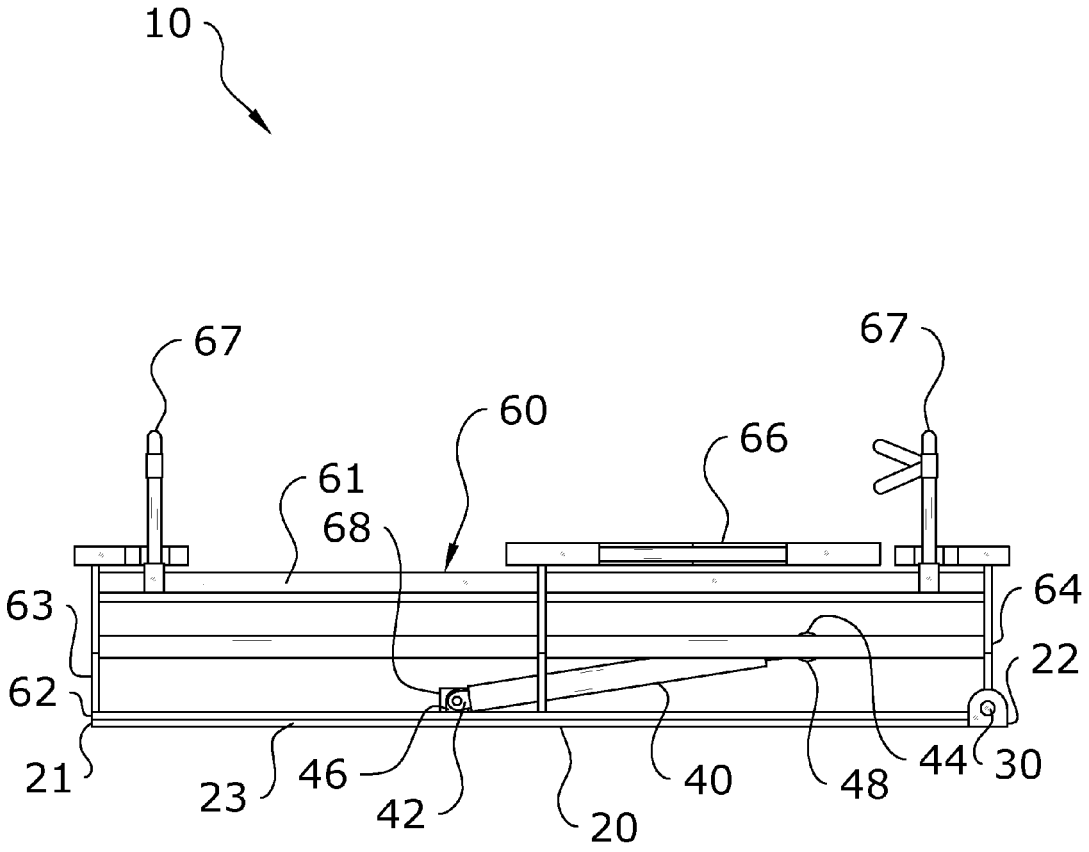
FIG. 3 is a side view of the present invention in a lowered position.
Figure 4:
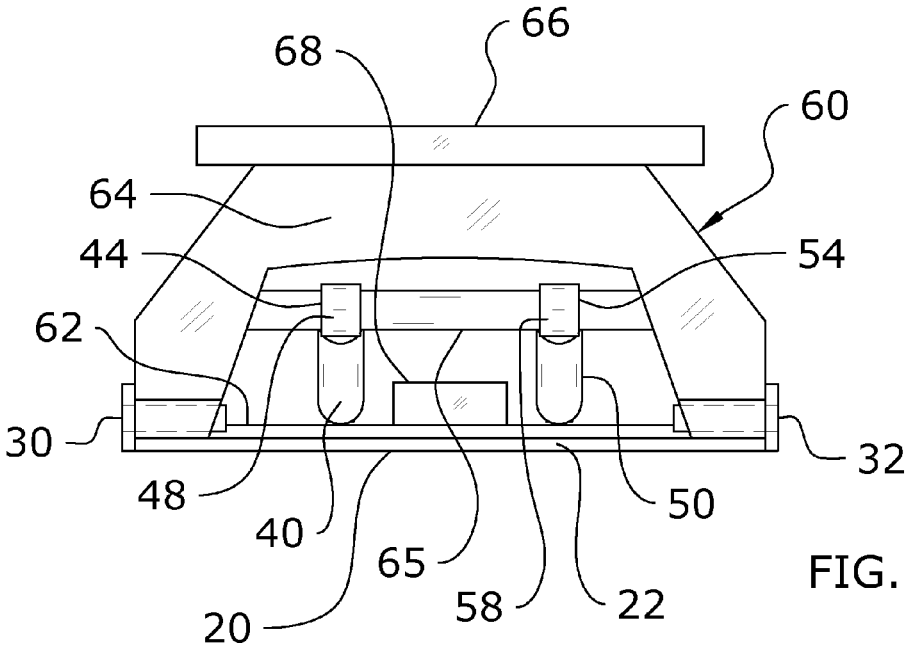
FIG. 4 is a rear view of the present invention in a lowered position.
Figure 5:
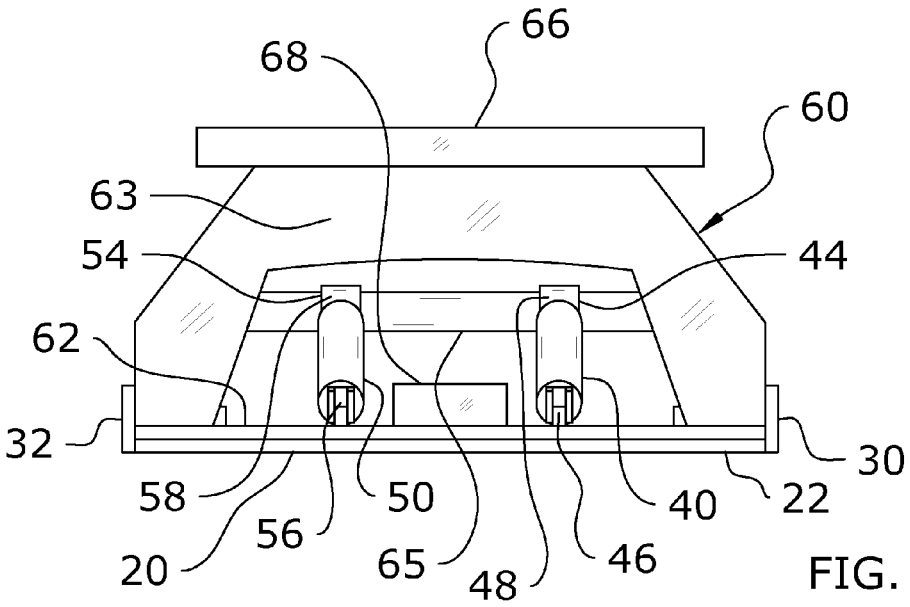
FIG. 5 is a frontal view of the present invention in a lowered position.
Figure 6:
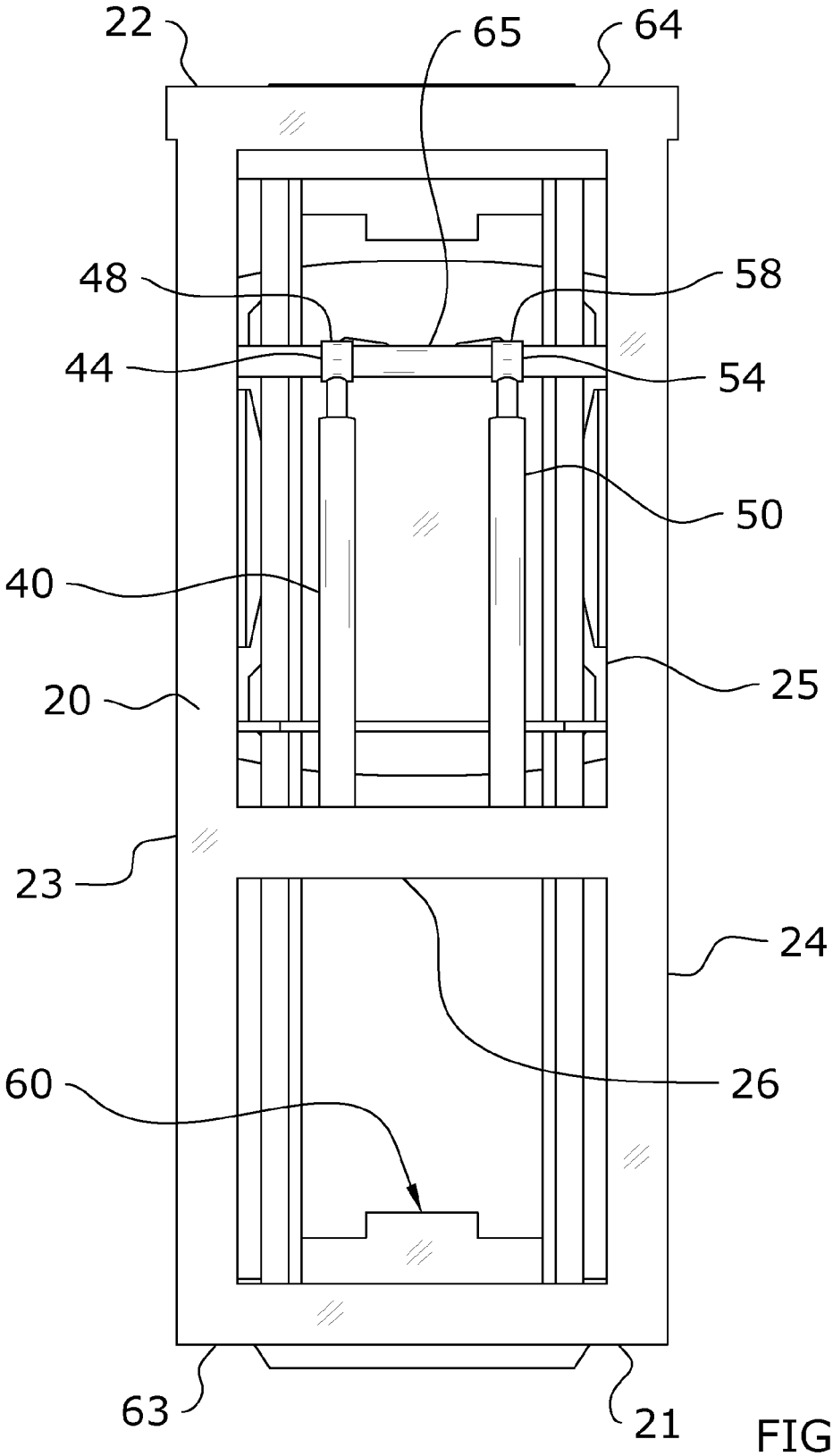
FIG. 6 is a bottom view of the present invention.

In the embodiment best shown in FIGS. 1-3, the base 20 generally includes a front end 21, a rear end 22, a first side 23, and a second side 24. The base 20 may be of a solid configuration or may be comprised of an outer frame as shown in the figures. The base 20 will rest upon the ground and remain stable as the exercise machine 60 is lifted or lowered to different levels of incline.

The base 20 may include an opening 25 defined by the first side 23, second side 24, rear end 22, and a cross bar 26 extending between the first and second sides 23, 24. The cross bar 26 may be located at various locations along the length of the base 20 between its front and rear ends 21, 22. In the embodiment shown in the figures, the cross bar 26 is located approximately ⅓ of the distance from the front end 21 to the rear end 22.

As best shown in FIG. 2, the first ends 42, 52 of the first and second actuators 40, 50 are secured to the cross bar 26 by a pair of actuator mounts 46, 56. However, it should be appreciated that the actuators 40, 50 could be located along various locations of the base 20, particularly in embodiments which may include a solid base 20. Thus, the mount location of the actuators 40, 50 on the base 20 may vary and should not be construed as limited by the exemplary figures.

C. Lift Assembly.

The present invention utilizes a lift assembly to allow the exercise machine 60 to be adjusted between various angles of incline with respect to the base 20. To effectuate the adjustment of inclination, the exercise machine 60 is hingedly or pivotably connected to the base 20 of the present invention and adjusted through usage of one or more actuators 40, 50, with the first ends 42, 52 of the actuators 40, 50 being secured to the base 20 and the second ends 44, 54 of the actuators 40, 50 being secured to the exercise machine 60.

The exercise machine 60 and base 20 may be pivotably attached in any number of manners. For example, a pivoting pin or rod may be utilized to interconnect the base 20 with the exercise machine 60. In other embodiments, hinges or the like may be utilized. In the embodiment shown in the figures, a first pivot connector 30 pivotably connects the rear end 64 of the exercise machine 60 with the first side 23 of the rear end 22 of the base 20. Similarly, a second pivot connector 32 pivotably connects the rear end 64 of the exercise machine 60 with the second side 24 of the rear end 22 of the base 20.

The structure, configuration, and type of pivot connector 30, 32 utilized may vary in different embodiments. In the exemplary figures, the pivot connectors 30, 32 comprise a pair of hinge-type configurations which are interconnect the base 20 and exercise machine 60 in a pivoting configuration. A first pivot connector 30 pivotably connects the first side 23 of the rear end 22 of the base 20 and a second pivot connector 30 pivotably connects the second side 24 of the rear end 22 of the base 20 with the exercise machine 60.

As shown throughout the figures, at least one actuator 40, 50 is connected between the base 20 and the exercise machine 60 such that the exercise machine 60 may be lifted or lowered into various angles of incline with respect to the base 20. Although the figures illustrate the usage of two actuators 40, 50, it should be appreciated that more or less actuators 40, 50 may be utilized in different embodiments.

The structure, size, and type of actuators 40, 50 used may also vary in different embodiments. The figures illustrate cylinder-type actuators 40, 50. It should be appreciated that other types of actuators 40, 50 known in the art may also be utilized to effectuate the lifting and lowering of the exercise machine 60 with respect to the base 20. It should also be appreciated that the actuators 40, 50 may be pneumatic, hydraulic, electric, or any other variant known in the art.

In the preferred embodiment shown in FIGS. 1, 2, and 4-6, a first actuator 40 extends between a point on the cross bar 26 adjacent to the first side 23 of the base 20 and a point on the actuator bar 65 adjacent to the first side of the exercise machine 60. A second actuator 50 extends between a point on the cross bar 26 adjacent to the second side 24 of the base 20 and a point on the actuator bar 65 adjacent to the second side of the exercise machine 60.

As best shown in FIGS. 2-5, the first end 42 of the first actuator 40 is pivotably connected to a first actuator mount 46 which is secured to the cross bar 26 adjacent to the first side 23 of the base 20. The second end 44 of the first actuator 40 is rotatably secured around the actuator bar 65 on the lower end 62 of the exercise machine 60. In the preferred embodiment shown in the figures, the second end 44 of the first actuator 40 includes a first actuator linkage 48 comprised of a ring-member which either partially or fully surrounds the actuator bar 65 so as to freely rotate therearound and force the exercise machine 60 up or down into various levels of incline with respect to the base 20.

As best shown in FIGS. 2-5, the first end 52 of the second actuator 50 is pivotably connected to a second actuator mount 56 which is secured to the cross bar 26 adjacent to the second side 24 of the base 20. The second end 54 of the second actuator 50 is rotatably secured around the actuator bar 65 on the lower end 62 of the exercise machine 60 in spaced-apart relationship with the first actuator 40. In the preferred embodiment shown in the figures, the second end 54 of the second actuator 50 includes a second actuator linkage 58 comprised of a ring-member which either partially or fully surrounds the actuator bar 65 so as to freely rotate therearound and aid in forcing the exercise machine 60 up or down into various levels of incline with respect to the base 20.

It should be appreciated that the foregoing is merely an exemplary description of one embodiment of the lift assembly, and that variations of the components thereof may vary in different embodiments. The type of connection between the exercise machine 60 and base 20 may vary, as well as the available angles of incline from use of the lift assembly. The placement, numbering, type, and size of actuators 40, 50 may vary. The connection points of the actuators 40, 50 may also vary so long as the exercise machine 60 may be lifted and lowered with respect to the base 20 as shown in the figures and described herein.

D. Exercise Machine.

The present invention is generally used in combination with an exercise machine 60. Various types of exercise machines 60 may be utilized. Although the figures illustrate a Pilates machine 60, it should be appreciated that other exercise machines 60 such as treadmills, ellipticals, edge machines, exercise bikes, and the like could also be utilized in combination with the base 20 and lift assembly of the present invention. In a preferred embodiment, the exercise machine 60 may be comprised of the "Exercise Machine" described and shown in U.S. Pat. No. 8,641,585, issued on Feb. 4, 2014, which is hereby fully incorporated by reference.

As shown throughout the figures, the exercise machine 60 may include an upper end 61, a lower end 62, a front end 63, and a rear end 64. The front end 63 will generally be raised and lowered while the rear end 64 remains pivotably secured to the base 20 when the present invention is being raised or lowered. This will allow adjustment of the levels of incline of the exercise machine 60 with respect to the base 20. Thus, the rear end 64 of the exercise machine 60 is generally pivotably connected to the rear end 22 of the base 20, such as by the pivot connectors 30, 32 shown in the figures.

In some embodiments utilizing, the upper end 61 of the exercise machine 60 may include a platform 66 which is slidably secured along tracks on the upper end 61 of the exercise machine 60. One or more handlebars 67 may also be included at the front end 63 and/or rear end 64 of the exercise machine 60. By utilizing the present invention, a wide range of exercises may be performed such as those shown in FIGS. 7-11.

In a preferred embodiment, the platform 66 is slidably upon the exercise machine 60 without the use of compression springs, bias members, cords, actuators, or the like. In such an embodiment, the platform 66 rolls freely along the upper end 61 of the exercise machine 60, with only the body weight of the exerciser providing resistance during exercises. Using this type of embodiment of the exercise machine 60, reliance will be placed on the angle of incline to determine the proper level of resistance for a higher or lower intensity workout.

The lower end 62 of the exercise machine 60 will generally include an actuator bar 65 around which the second ends 44, 54 of the respective actuators 40, 50 will be rotatably secured. The shape, size, length, and cross-section of the actuator bar 65 may vary in different embodiments. The actuator bar 65 will generally extend between the sides of the lower end 62 of the exercise machine 60 adjacent to its rear end 64 as shown throughout the figures.

E. Controller.

Figure 13:
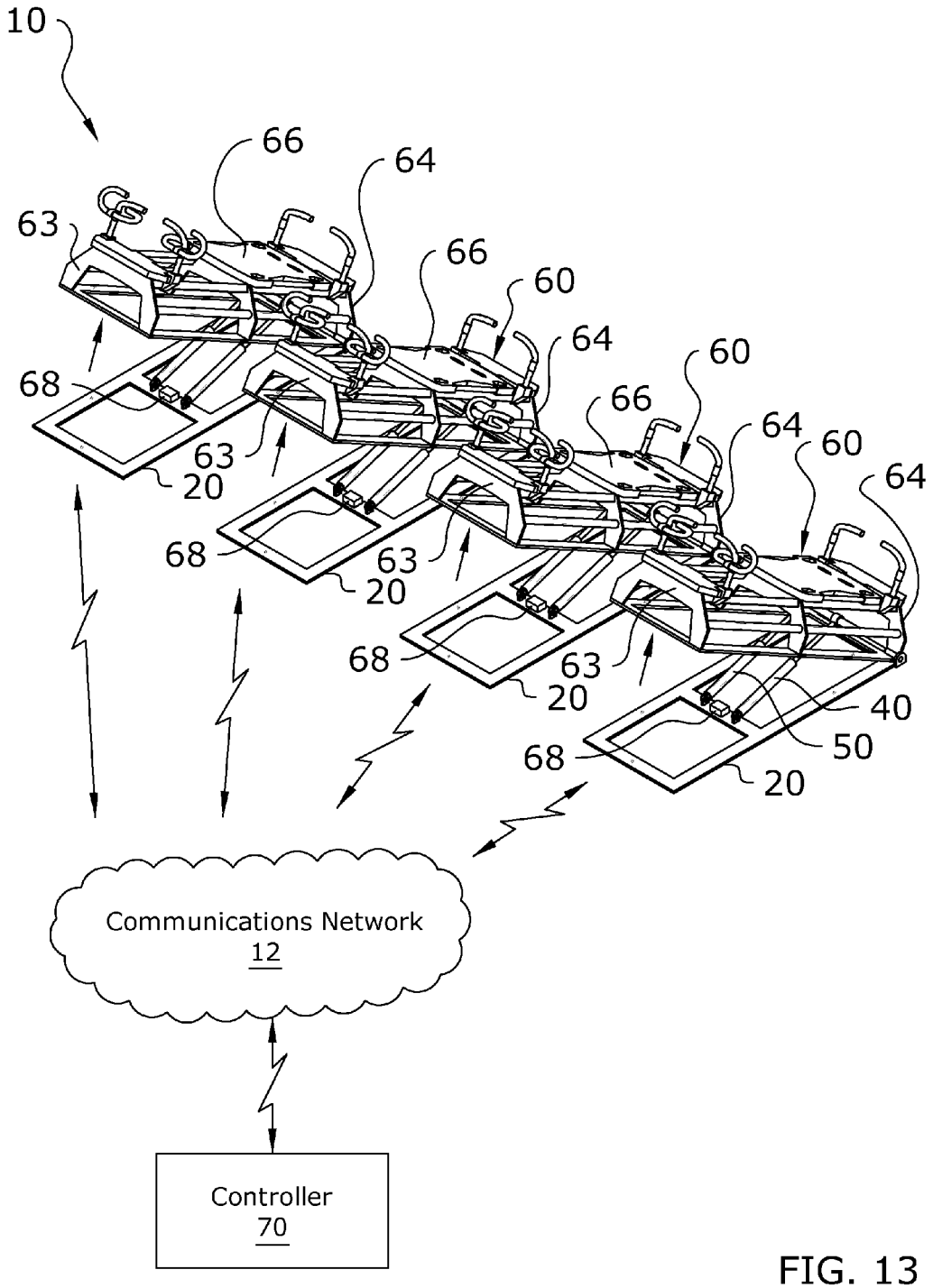
FIG. 13 is an upper perspective view illustrating adjustment of multiple adjustable exercise systems being controlled by a single controller through a communications network.
Figure 14:
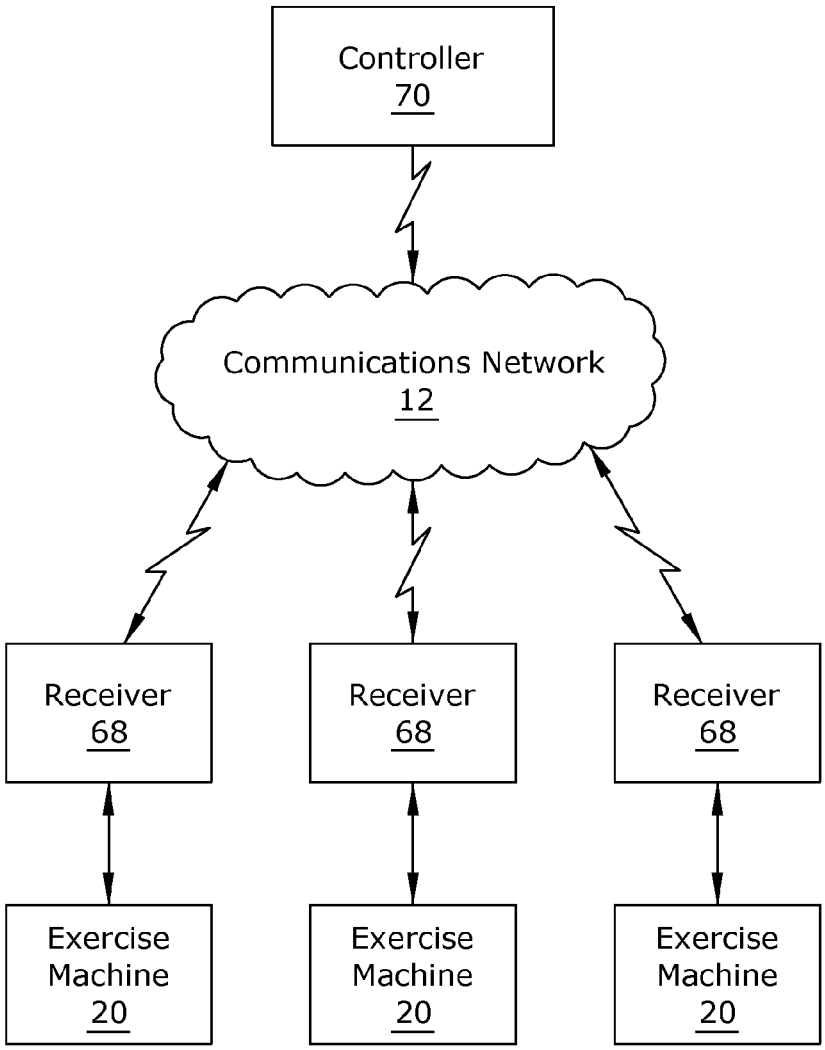
FIG. 14 is a block diagram illustrating interconnection of multiple adjustable exercise systems with a single controller through a communications network.
Figure 15:
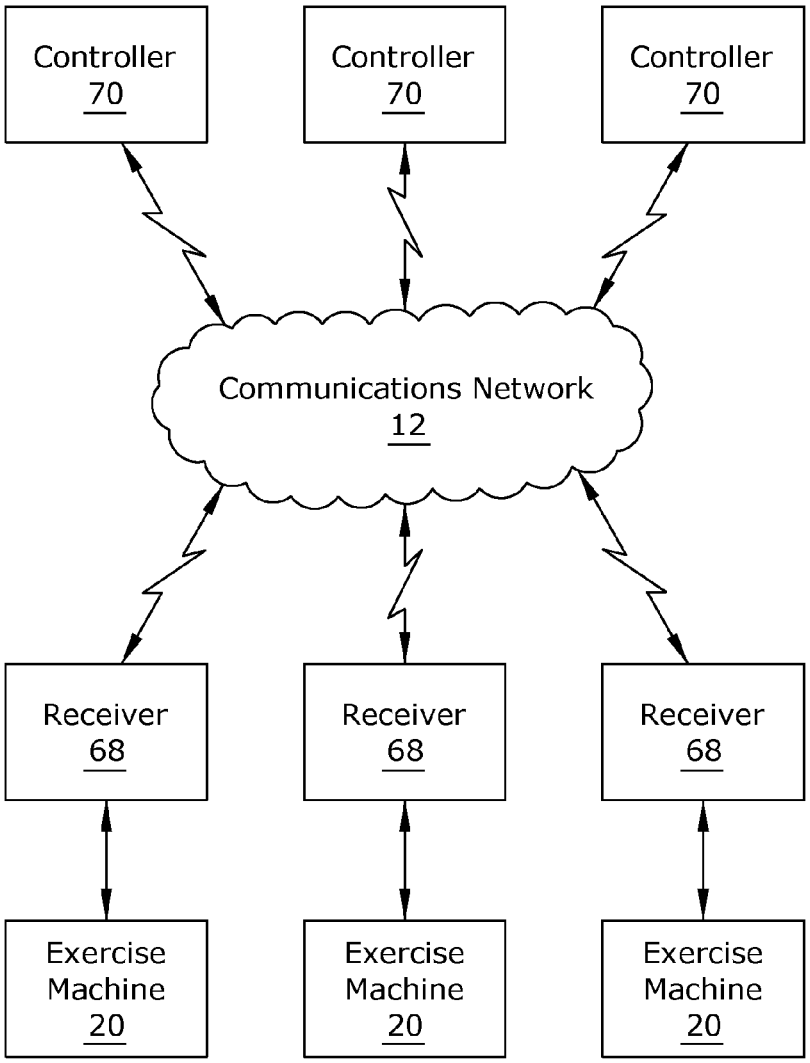
FIG. 15 is a block diagram illustrating interconnection of multiple adjustable exercise systems with multiple controllers through a communications network.

As shown in FIGS. 13-15, the present invention may include a controller 70 for controlling the angle of incline of the exercise machine 60 with respect to the base 20. In some embodiments, each of the adjustable exercise systems 10 includes its own controller 70, with each individual exerciser having control of his/her own system 10.

Figure 12:
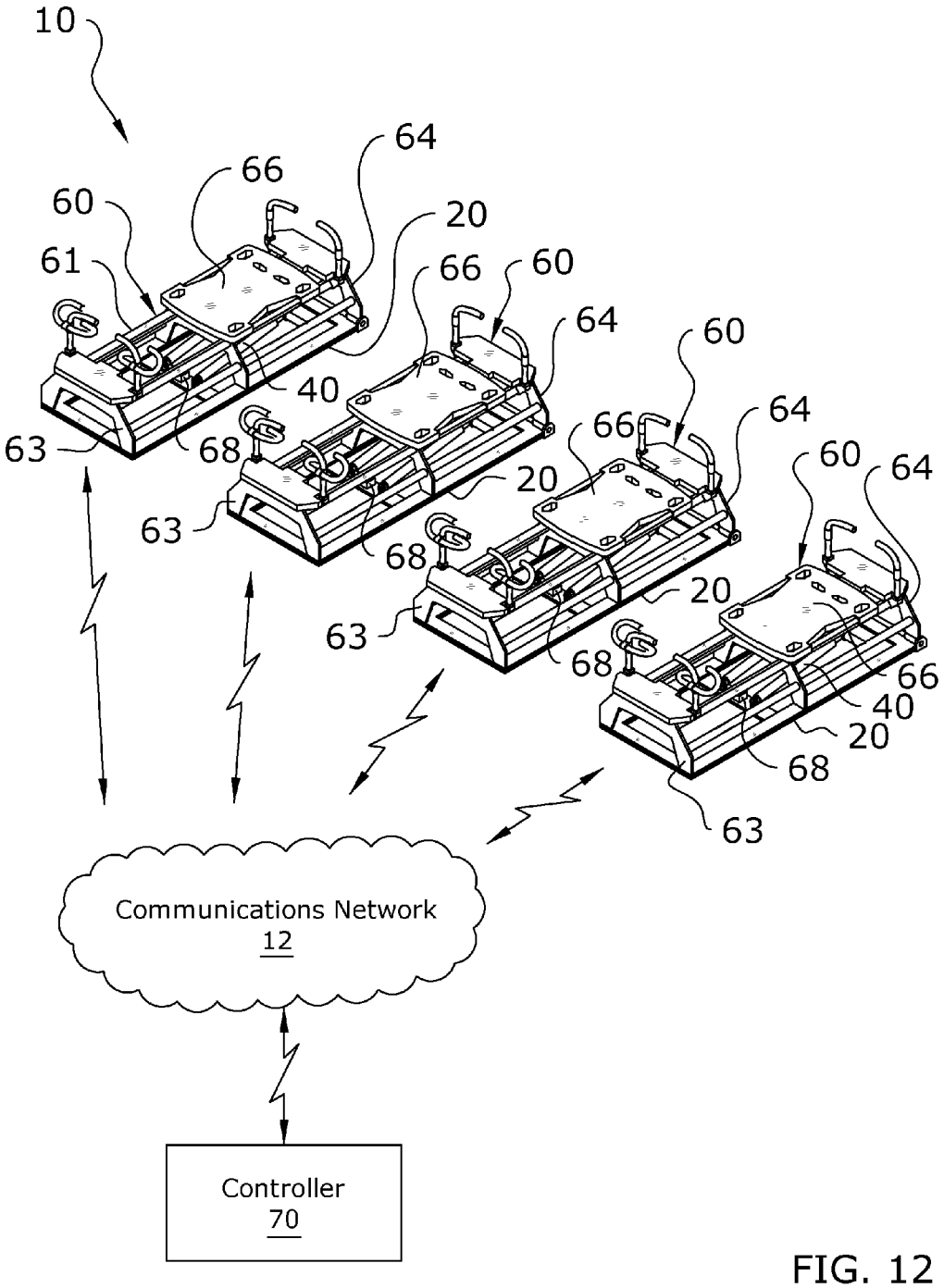
FIG. 12 is an upper perspective view illustrating multiple adjustable exercise systems being controlled by a single controller through a communications network.

In other embodiments, it may be desirable for an exercise instructor to control multiple adjustable exercise systems 10 for a plurality of exercisers, such as in the context of a workout class. In such embodiments, the instructor will have a single controller 70 which is adapted to control the incline of a plurality of adjustable exercise systems 10. Such an embodiment is best shown in FIGS. 12-14. By entering an incline level into the controller 70, the adjustable exercise systems 10 of a plurality of exercisers may be simultaneously adjusted by the instructor.

A wide range of controllers 70 may be used with the present invention. Preferably, the controller 70 will be a handheld device adapted to control the present invention. The controller 70 may be a computer, smart phone, tablet or the like running a specialized software program for controlling the adjustable exercise systems 10. Alternatively, the controller 70 may be a device specifically configured for the sole purpose of controlling the adjustable exercise systems 10.

The controller 70 will communicate via a communications network 12 with one or more corresponding receivers 68 on the adjustable exercise systems 10. It should be appreciated that the receivers 68 may be located along various locations on the present invention, and should not be construed as being limited to a location between the actuators 40, 50 as shown in the figures.

The type of communications network 12 may vary in different embodiments, including, for example, WI-FI, Bluetooth, RFID, wired signals sent through conduits, and the like. It should be appreciated that any communications network 12 known in the art for transmitting signals to a receiver 68 either through wires or wirelessly may be utilized with the present invention.

F. Operation of Preferred Embodiment.

FIGS. 7-11 provide illustrations of some exemplary uses of the present invention. In use, the base 20 is positioned on the ground with the exercise machine 60 in its lowered position. In such a lowered position as shown in FIG. 2, the user of the present invention may perform a wide range of exercises at a first level of intensity defined by the zero-degree angle of incline between the base 20 and the exercise machine 60.

When desired, the exercise machine 60 may be lifted to various angles of incline with respect to the base 20 so as to increase the intensity of the workout when compared with the lowered position shown in FIG. 2. To lift the exercise machine 60 with respect to the base 20, the actuators 40, 50 may be activated to extend outwardly as discussed below. As the actuators 40, 50 are extended, force is applied to the actuator bar 65 of the exercise machine 60.

Because the actuator linkages 48, 58 of the actuators 40, 50 are rotatably secured around the actuator bar 65, which is fixed to the exercise machine 60, the extension of the actuators 40, 50 will cause front end 63 of the exercise machine 60 to rise while the rear end 64 of the exercise machine 60 remains anchored to the rear end 22 of the base 20 by the pivot connectors 30, 32. Thus, the angle of incline between the base 20 and exercise machine 60 may be increased by extending the actuators 40, 50.

Figure 7:
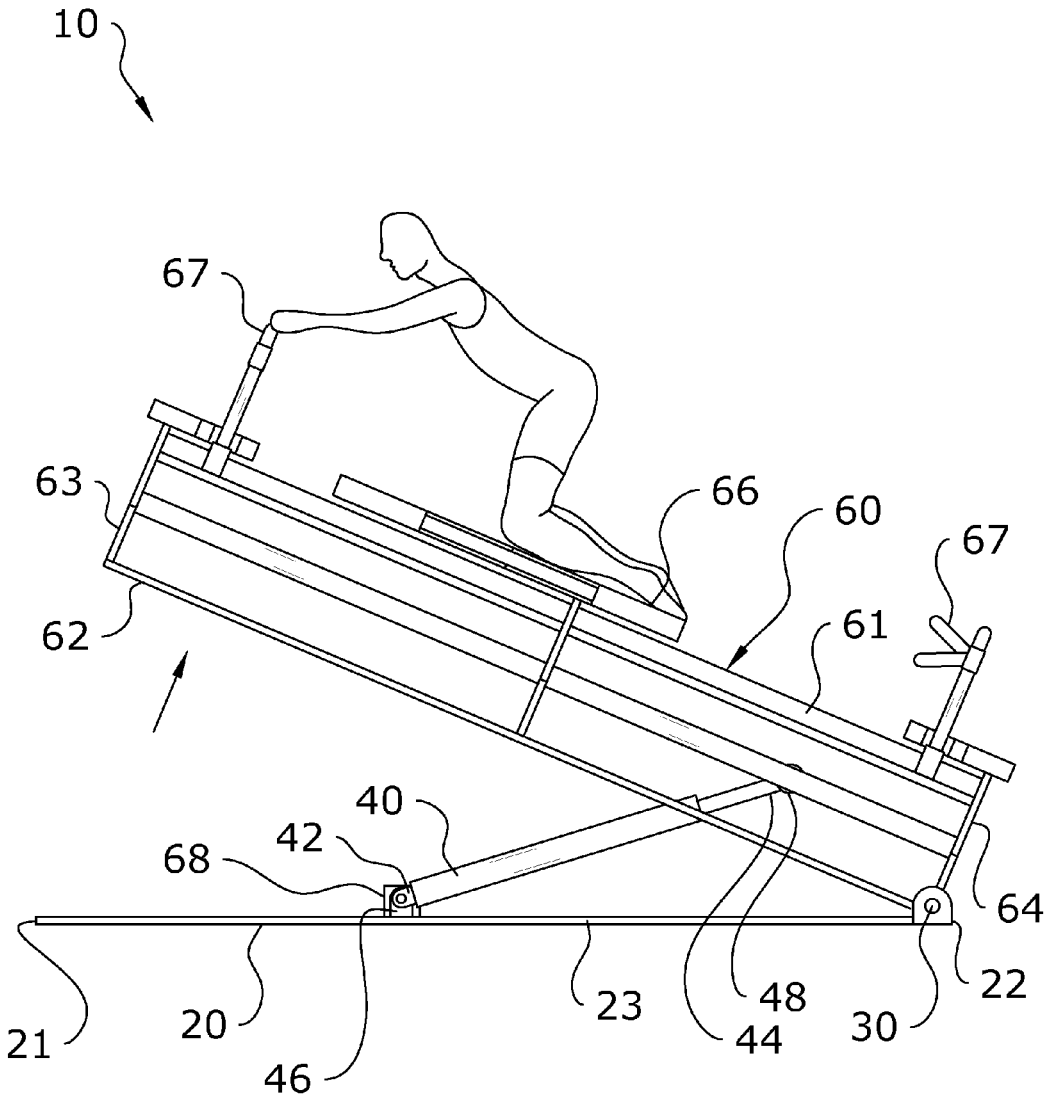
FIG. 7 is a side view of the present invention illustrating an exercise being performed at a first angle of incline.
Figure 8:
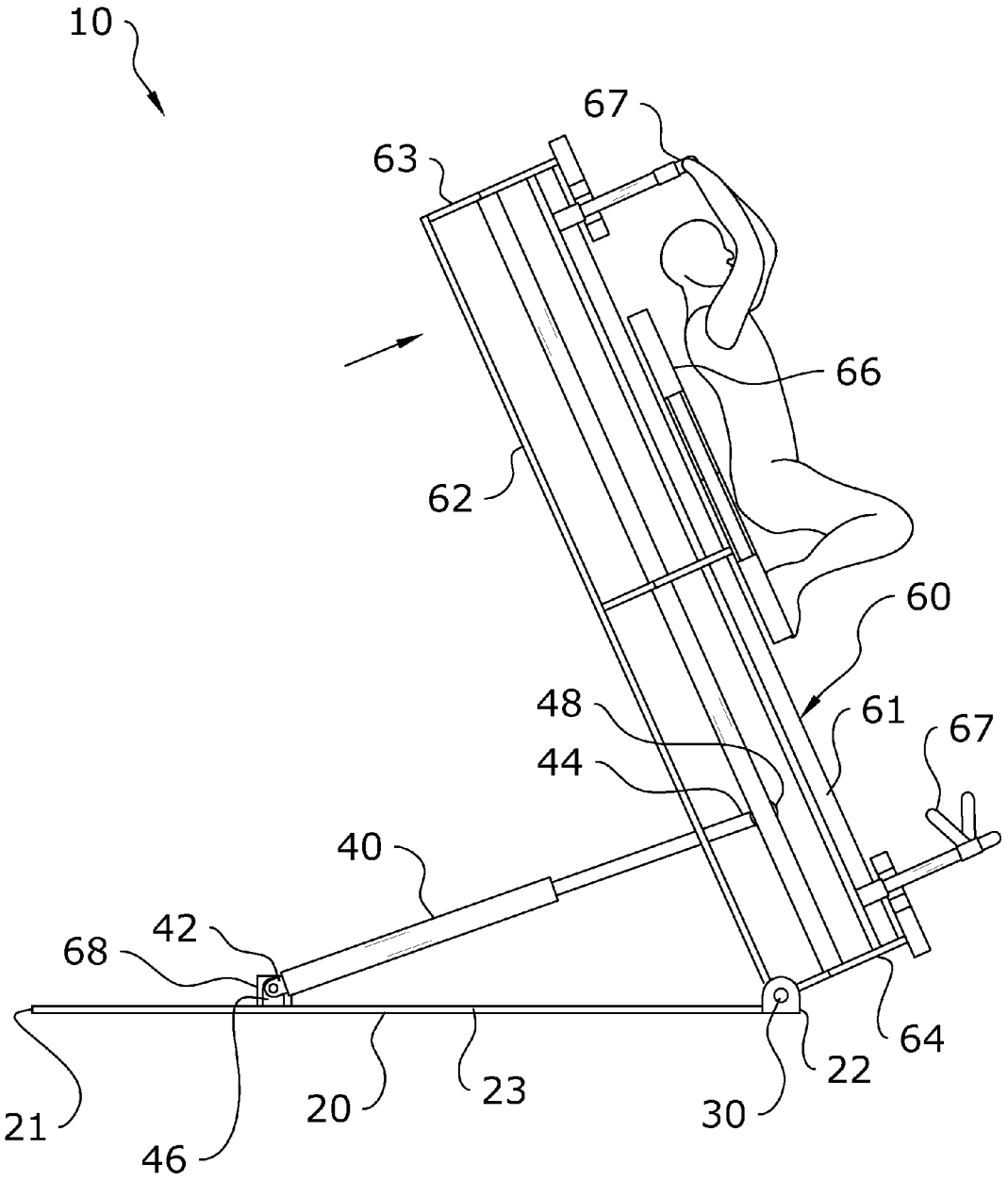
FIG. 8 is a side view of the present invention illustrating an exercise being performed at a second angle of incline.
Figure 9:
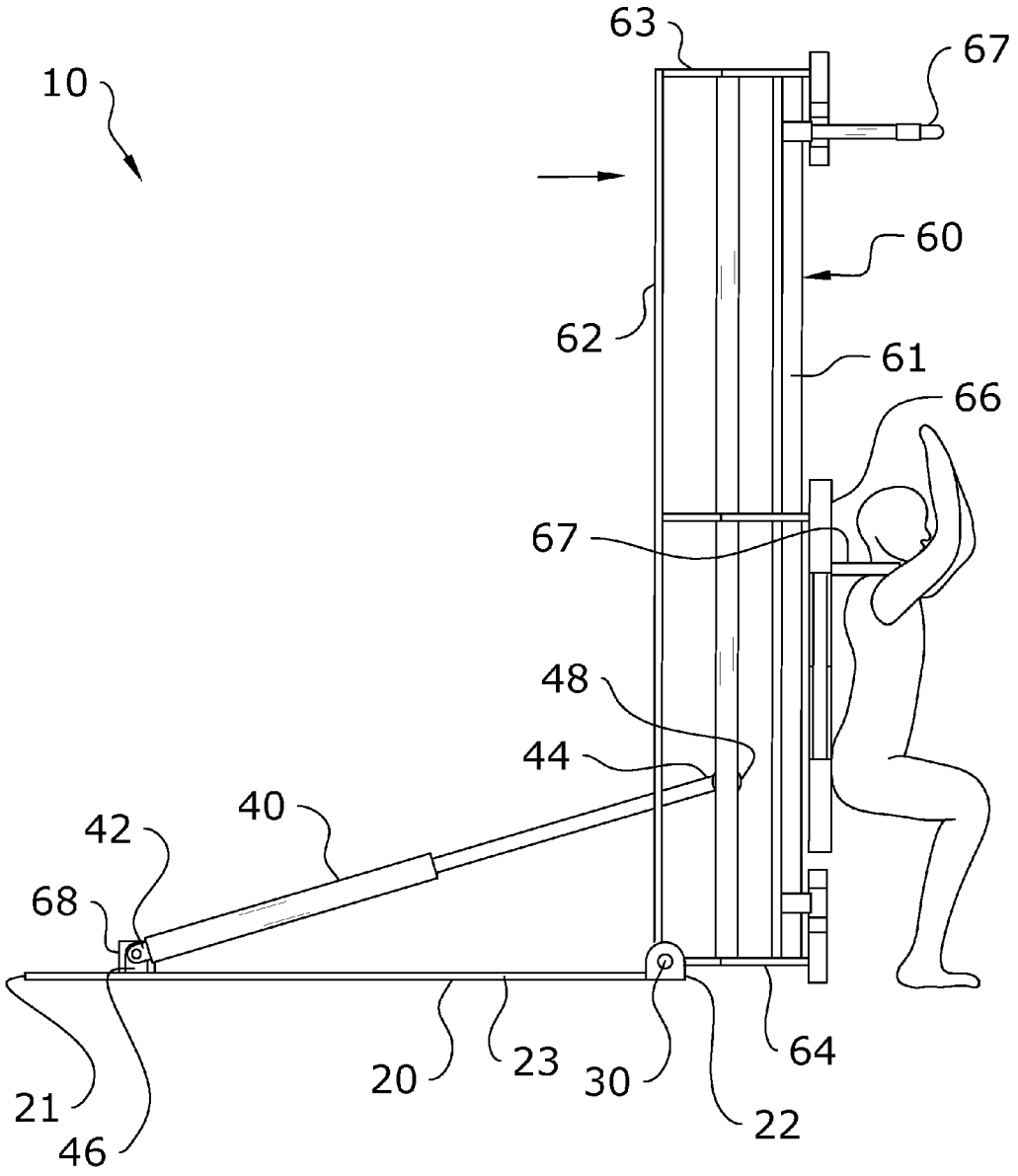
FIG. 9 is a side view of the present invention illustrating an exercise being performed at a third angle of incline.

During exercise, the angle of incline between the base 20 and exercise machine 60 may be freely adjusted up or down to accommodate different levels of intensity. Preferably, the present invention will be adapted to adjust between a 0 degree angle of incline as shown in FIG. 2 and 90 degree angle of incline as shown in FIG. 9. FIGS. 7-9 illustrate various levels of incline for use with the present invention; each representing a different level of intensity and showing alternate exercises capable of being performed with the present invention.

Figure 10:
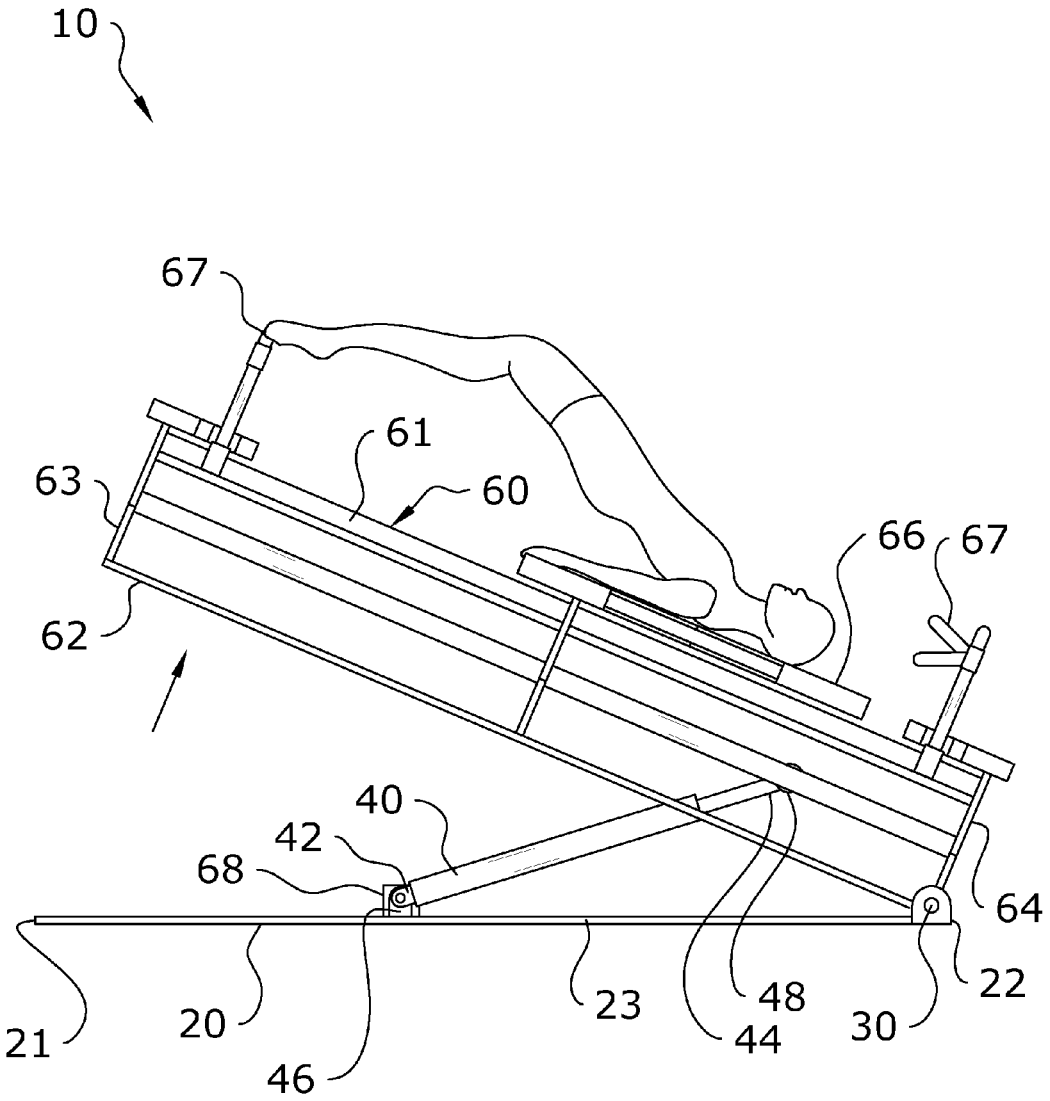
FIG. 10 is a side view of the present invention illustrating the first position of an exercise at an angle of incline.
Figure 11:
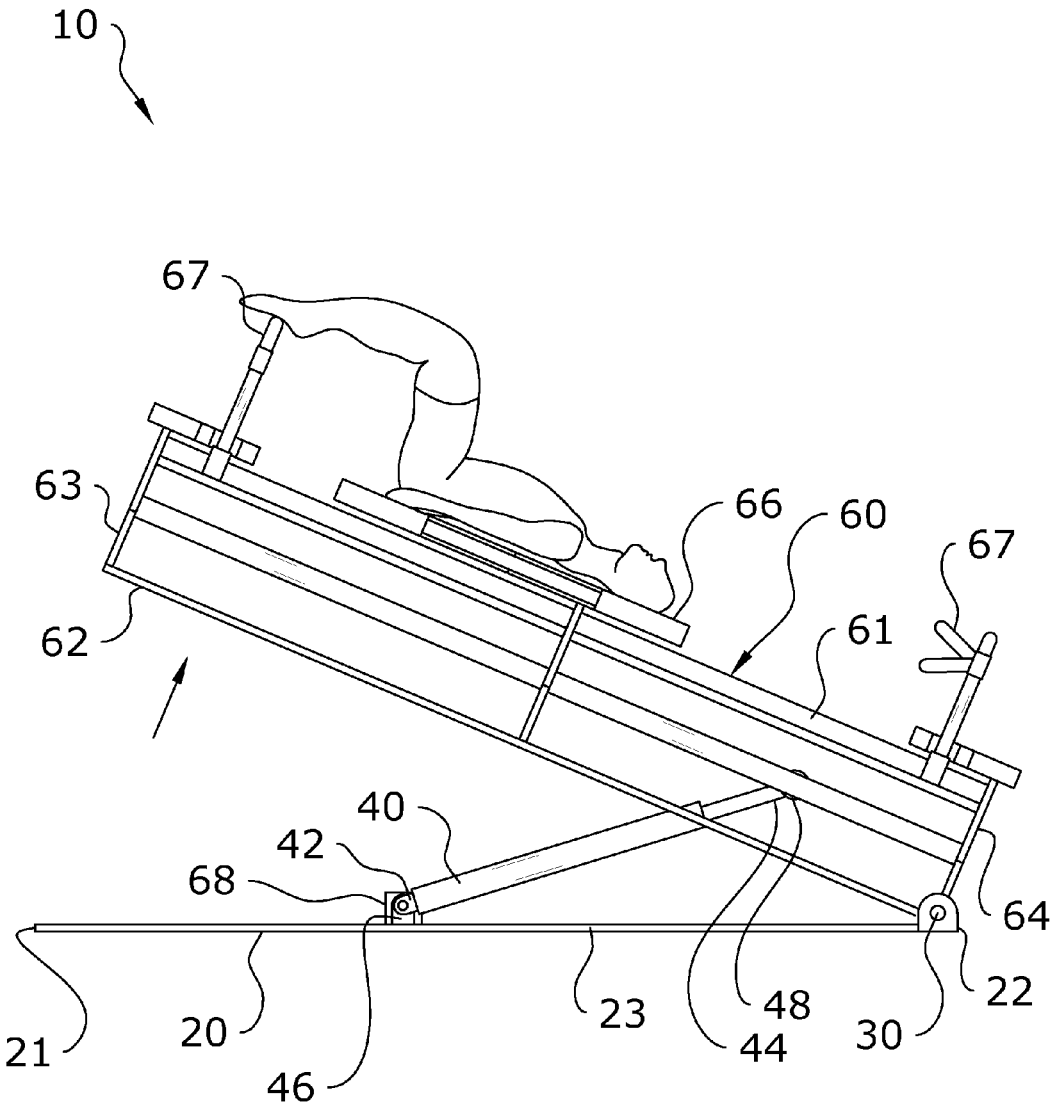
FIG. 11 is a side view of the present invention illustrating the second position of an exercise at an angle of incline.

FIGS. 10 and 11 illustrate exercises suitable for use with an exercise machine 60 comprised of a Pilates machine. With an angle of incline set, the user of the present invention will rest upon the platform 66 of the exercise machine 60 with his/her feet positioned on the handlebars 67. As shown in FIG. 11, the user may slide the platform 66 along the exercise machine 60 to perform Pilates exercises. These exercises are more intensive and efficient than maneuvers on prior art systems due to the additional resistance added by the angle of incline between the base 20 and the exercise machine 60.

It should be appreciated that the present invention may be adapted for use in individual workouts or as part of a group of adjustable exercise systems 10 each performing exercises together in response to instructions from an exercise instructor. As previously described, it is therapeutically and commercially beneficial for a rehabilitation therapist or fitness instructor to vary the incline angle of the present invention before, during, and/or after an exercise session.

For instance, as a safety measure, an exercise instructor may prefer to have one or more exercisers mount one or more of the present invention while the exercise machine 20 is substantially horizontal. Once the instructor starts the class session and the exercisers begin exercising, the instructor may change the incline angles, and therefore the intensity of the exercise for one or more exercisers in a class.

Using a controller 70 located remotely from the apparatuses, the instructor may select either a preprogrammed sequence, or manually set the desired incline angle of the apparatuses at any time during the exercise session. The controller 70 output function is a signal that is communicated via a communications network 12 to a corresponding receiver 68 on each of the exercise machines 60 adapted to receive such signals.

Via the communications network 12, the controller 70 communicates with one or more of the adjustable exercise systems 10, each of which is also connected wirelessly to, and addressable through the network 12. The signals are sent from the controller 70 to the adjustable exercise systems 10 to actuate the actuators 40, 50, either to increase or decrease the angle of incline, thereby increasing or decreasing the exercise intensity in real time.

As shown in FIGS. 12-14, an incline angle controller 70 is wirelessly connected to one or more incline-variable adjustable exercise systems 10 via a communications network 12. As a person (exerciser or instructor) uses the controller 70 to change the incline angle of the exercise machine 60, the controller 70 sends a signal via the communications network 12 to the receiver(s) 68 of one or more adjustable exercise systems 10. In embodiments in which the communications network 12 comprises Bluetooth, a Bluetooth signal receiver 68 will have been previously installed on the adjustable exercise systems 10 to receive and decodes the signal from a Bluetooth controller 70 and direct the actuators 40, 50 to increase or decrease the incline angle.

In the foregoing, it should be noted that the controller 70 may incorporate preprogrammed sequences to allow for an instructor to create, store and execute an exercise sequence, or for the controller 70 to simultaneously control all adjustable exercise systems 10, or separately control individual adjustable exercise systems 10 or groups of adjustable exercise systems 10 comprised of fewer than all adjustable exercise systems 10 within an exercise space.

Figure 16:
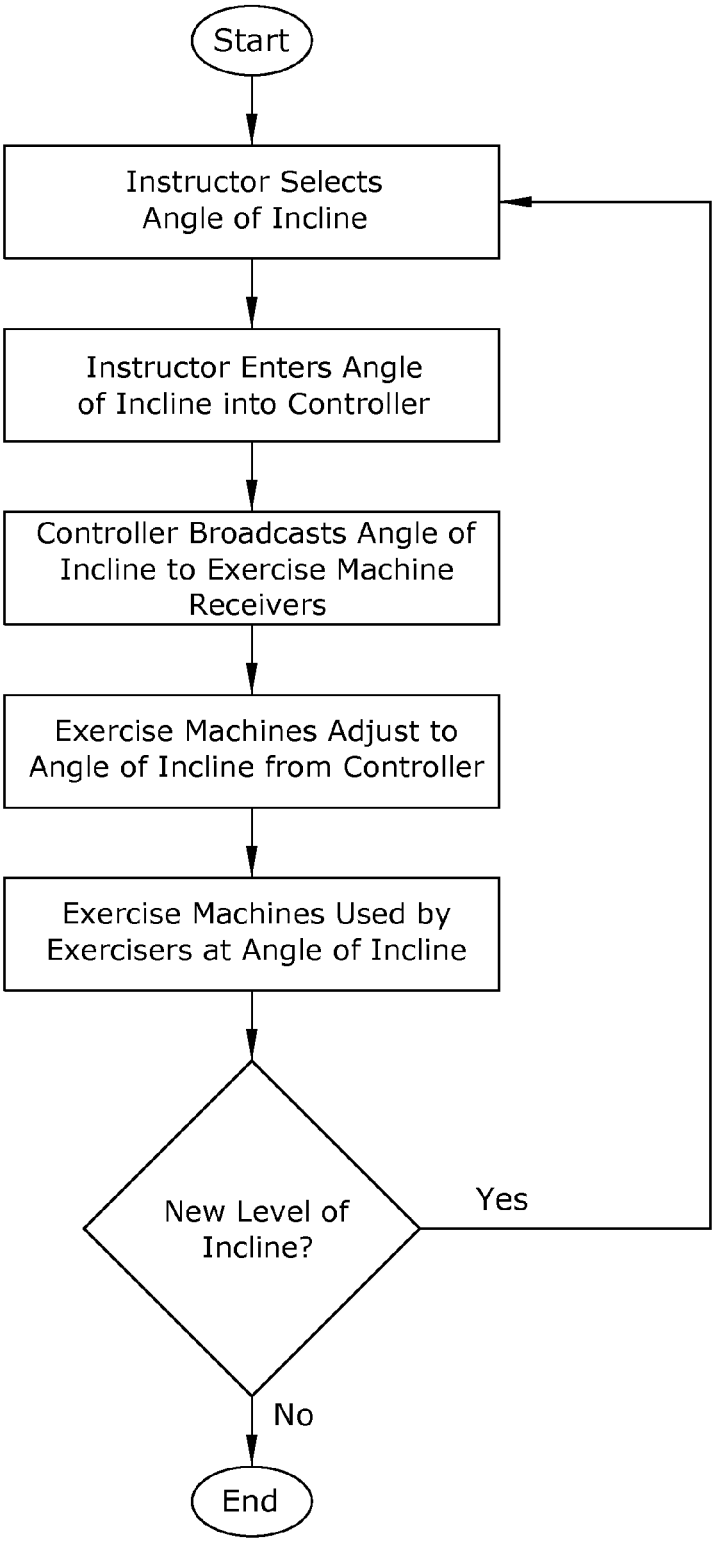
FIG. 16 is a flowchart illustrating instructor-led adjustment of angles of incline for multiple adjustable exercise systems.
Figure 17:
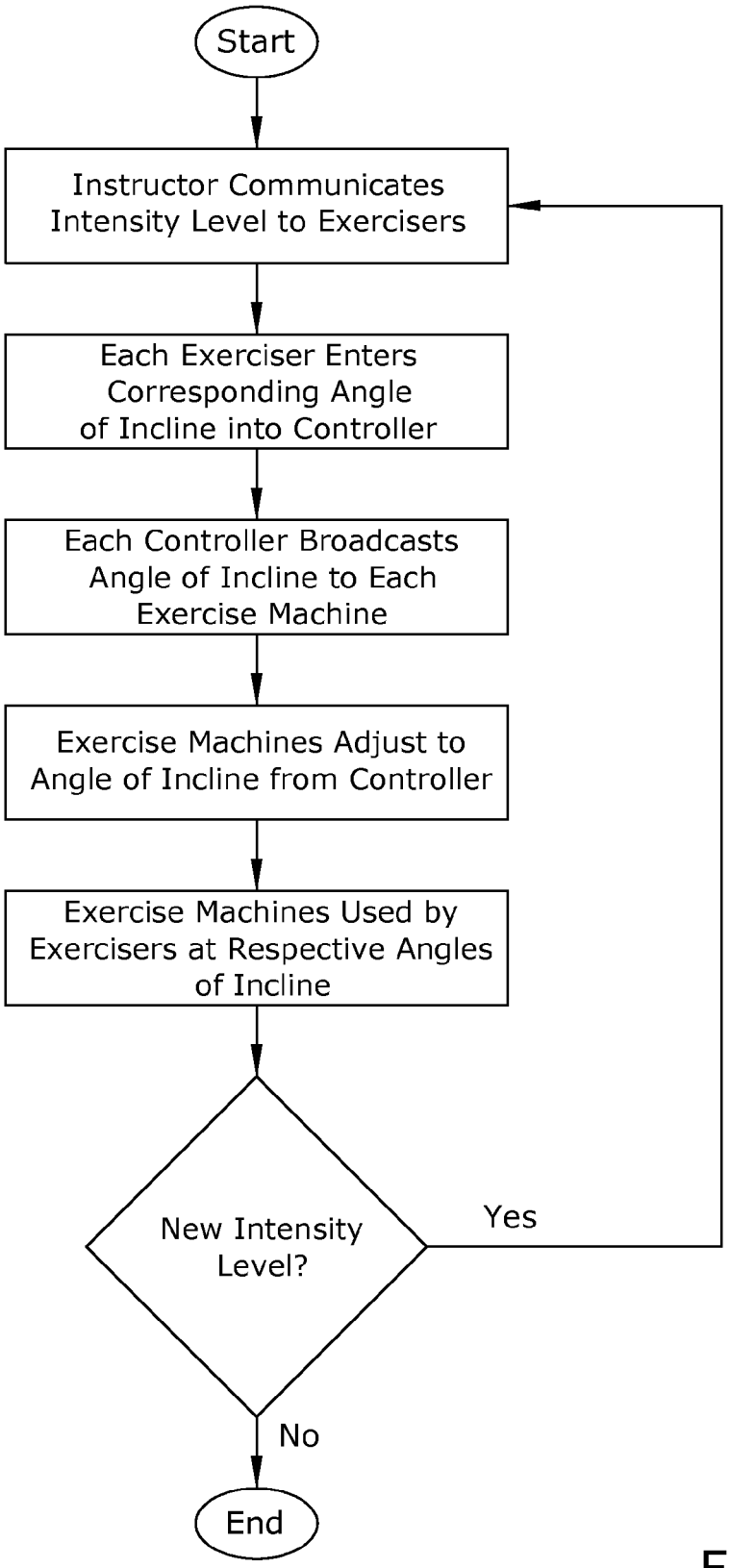
FIG. 17 is a flowchart illustrating individual exerciser adjustment of angles of incline for an adjustable exercise system.

FIG. 16 is a flowchart illustrating a plurality of exercisers each on their own adjustable exercise machine 10 which are controlled by a single instructor controller 70. FIG. 17 is a flowchart illustrating a single exerciser controlling his/her own adjustable exercise machine 10 with his/her own controller 70 in response to instructions from an exercise instructor.

Prior to the start of an exercise sequence, one or more exercisers mount one or more adjustable exercise systems 10. Once the exercisers are properly positioned upon the adjustable exercise systems 10, an instructor prepares to start an exercise session. Using a controller 70, the instructor launches a software program that allows the instructor to select any number of pre-programmed exercises or exercise sequences, such exercises or exercise sequences having been programmed by a manufacturer, or by the instructor. The instructor then initiates the sequence by starting the program on the controller 70.

The controller is connected to each and all of the adjustable exercise systems 10 by a variety of methods including wirelessly through a network 12 such as via a Bluetooth connection or by a physical wire (not shown) through which the controller 70 signals pass. It should be noted that any particular controlling device that controls the incline of a particular Pilates apparatus may be mounted on or near that particular apparatus for the express purpose of controlling the exercise sequence and/or incline/decline angle of the upper structure of only that particular apparatus.

A receiver 68 integral to each of the adjustable exercise systems 10 comprises a signal receiver which is adapted to adjust the actuators 40, 50 responsive to signals received from the controller 70. Throughout the duration of the exercise cycle, or during various times during the performance of the exercise cycle, the controller 70 sends signals to adjustable exercise systems 10 that direct the incline actuators 40, 50 to increase or decrease the incline angle, thereby correspondingly increasing or decreasing the workout intensity that results when an increased or decreased portion of each exerciser's body weight is correspondingly added or subtracted from the total resistance force encountered during the exercise.

Either a result of an instructor manually ending the exercise, or because the preprogrammed sequence has been completed, the controller 70 in communication with the apparatuses sends a signal at the end of the exercise, thereby instructing the adjustable exercise systems 10 to remain in their most recent positions, or change the incline angle to return to a preprogrammed starting position.

It should be noted that the present invention anticipates the exerciser's possible preference of using their own program having been selected on a mobile application contained on a smartphone, with provisions allowing the smartphone to be paired with the exerciser's apparatus, thereby controlling the apparatus during the exercise period. In such an embodiment as shown in FIG. 15, each of the exerciser's may have their own controller 70 to control their own adjustable exercise machine 10. These individual controllers 70 may be preprogrammed with pre-set workout routines or may be individually controllable by each exerciser in response to instructions from the instructor.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An adjustable exercise system, comprising:

a first base;

a first exercise machine pivotably connected to said first base;

at least one first actuator connected between said first base and said first exercise machine for adjusting a first angle of incline for said first exercise machine;

a second base;

a second exercise machine pivotably connected to said second base; and at least one second actuator connected between said second base and said second exercise machine for adjusting a second angle of incline for said second exercise machine.

2. The adjustable exercise system of claim 1, further comprising a first controller for controlling said first angle of incline for said first exercise machine.

3. The adjustable exercise system of claim 2, further comprising a first receiver for receiving a signal from said first controller via a communications network.

4. The adjustable exercise system of claim 3, wherein said communications network is comprised of a wireless network.

5. The adjustable exercise system of claim 3, wherein said communications network is comprised of a wired connection between said first controller and said first receiver.

6. The adjustable exercise system of claim 1, wherein said angle of incline is comprised of between 0 degrees and 90 degrees.

7. The adjustable exercise system of claim 1, further comprising a first controller for controlling said first angle of incline for said first exercise machine and a second controller for controlling said second angle of incline for said second exercise machine.

8. The adjustable exercise system of claim 7, further comprising a first receiver for receiving a first signal from said first controller via a communications network and a second receiver for receiving a second signal from said second controller via said communications network.

9. The adjustable exercise system of claim 8, wherein said communications network is comprised of a wireless network.

10. The adjustable exercise system of claim 7, wherein said first angle of incline and said second angle of incline are each between 0 degrees and 90 degrees.

11. The adjustable exercise system of claim 1, wherein said first angle of incline does not equal said second angle of incline.

12. The adjustable exercise system of claim 7, wherein said first controller is comprised of a smart phone.

13. The adjustable exercise system of claim 1, further comprising a controller for controlling said first angle of incline for said first exercise machine and said second angle of incline for said second exercise machine.

14. The adjustable exercise system of claim 13, wherein said controller is comprised of a computer.

15. The adjustable exercise system of claim 13, wherein said first exercise machine includes a first receiver and wherein said second exercise machine includes a second receiver, wherein said first receiver and said second receiver are each communicatively interconnected with said controller by a communications network.

16. The adjustable exercise system of claim 15, wherein said communications network is comprised of a wireless network.

17. The adjustable exercise system of claim 1, wherein said first angle of incline is comprised of an angle between said exercise machine and a ground surface.

18. The adjustable exercise system of claim 1, wherein said first base and said second base are comprised of the same structure.

19. The adjustable exercise system of claim 1, wherein said first exercise machine and said second exercise machine each include a track and a platform slidably secured to said track.

20. The adjustable exercise system of claim 19, wherein said first exercise machine and said second exercise machine each include a first handlebar and a second handlebar.

21. The adjustable exercise system of claim 1, wherein said first exercise machine and said second exercise machine are each comprised of a Pilates machine.

22. An adjustable exercise system, comprising:

a base including a front end and a rear end, wherein said base includes a cross bar;

an exercise machine including a front end and a rear end, wherein said exercise machine includes an actuator mount, wherein said rear end of said exercise machine is pivotably connected to said rear end of said base;

a first actuator, wherein a first end of said first actuator is pivotably connected to said cross bar and wherein a second end of said first actuator is rotatably connected around said actuator mount;

a second actuator, wherein a first end of said second actuator is pivotably connected to said cross bar and wherein a second end of said second actuator is rotatably connected around said actuator mount, wherein said first and second actuators are each adapted to lift or lower said exercise machine between a plurality of angles of incline with respect to said base; and a controller for controlling said first actuator and said second actuator.

* * * * *